US009409234B2

(12) United States Patent
Haubold et al.

(10) Patent No.: US 9,409,234 B2
(45) Date of Patent: Aug. 9, 2016

(54) ONE-PIECE COMPONENT AND METHOD FOR ITS PRODUCTION

(71) Applicants: Tilla Haubold, Dortmund (DE); Matthias Schumacher, Weissach (DE)

(72) Inventors: Tilla Haubold, Dortmund (DE); Matthias Schumacher, Weissach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 74 days.

(21) Appl. No.: 13/760,181

(22) Filed: Feb. 6, 2013

(65) Prior Publication Data

US 2013/0209815 A1 Aug. 15, 2013

(30) Foreign Application Priority Data

Feb. 9, 2012 (DE) ..... 10 2012 201 880

(51) Int. Cl.

| | |
|---|---|
| ***B22F 7/02*** | (2006.01) |
| ***B22F 7/06*** | (2006.01) |
| ***B22F 3/22*** | (2006.01) |

(52) U.S. Cl.

CPC ... *B22F 7/02* (2013.01); *B22F 3/22* (2013.01); *B22F 7/06* (2013.01)

(58) Field of Classification Search

None

See application file for complete search history.

(56) References Cited

U.S. PATENT DOCUMENTS

| | | | | |
|---|---|---|---|---|
| 4,491,558 | A * | 1/1985 | Gardner | 419/23 |
| 5,364,586 | A * | 11/1994 | Trusov et al. | 419/2 |
| 7,393,559 | B2 * | 7/2008 | Groza et al. | 427/192 |
| 2006/0037660 | A1 * | 2/2006 | Kinnally et al. | 138/143 |
| 2011/0236713 | A1 * | 9/2011 | Radwan et al. | 428/610 |

OTHER PUBLICATIONS

Grujicic et al. Materials Science and Engineering, A252, 1998, 117-132.*

Notomi et al. JP 04-116108, Sep. 7, 1990 Human Translation.*

* cited by examiner

*Primary Examiner* — Vera Katz

(74) *Attorney, Agent, or Firm* — Norton Rose Fulbright US LLP

(57) ABSTRACT

A one-piece component includes a first subregion made of a base material, and a second subregion made of the base material as binder with intercalated hard material particles, the second subregion being injection-molded onto the first subregion by means of MIM injection molding, so that an integral connection is formed between the first subregion and the second subregion. Furthermore, a method for producing the one-piece component by means of MIM injection molding is described.

4 Claims, 2 Drawing Sheets

ONE-PIECE COMPONENT AND METHOD FOR ITS PRODUCTION

CROSS-REFERENCE TO RELATED APPLICATION

The present application claims priority to Application No. DE 10 2012 201 880.8, filed in the Federal Republic of Germany on Feb. 9, 2012, which is expressly incorporated herein in its entirety by reference thereto.

FIELD OF INVENTION

The present invention relates to a one-piece component which has a first and a second subregion, and to a method for producing the one-piece component by means of a MIM (Metal Injection Molding) method.

BACKGROUND INFORMATION

Many components which are moving or which serve as stops are subjected to wear. Therefore there is a need to provide components that have the most advantageous wear characteristics possible. In addition, greater wear occurs if sufficient lubrication in the case of moved components, or sufficient damping in the case of stops is impossible. One pertinent example are devices for injecting fuel, in particular gasoline, since gasoline exhibits very poor lubricating properties. To provide the highest possible service life for gasoline injectors, for example, highly wear-resistant materials are used as a rule, which have the particular disadvantage of being very costly. As an alternative, it is also possible to use supplementary components, such as wear-resistant bushings or the like; however, this increases the number of parts as well as the production and installation costs. In this regard, cost-effective alternatives would thus be desirable, which could solve the wear problems without additional individual components and/or additional working steps.

SUMMARY

By contrast, the one-piece component according to the present invention has the advantage that it may be produced in an especially simple as well as cost-effective manner within the shortest period of time. According to the present invention, this is achieved by producing the one-piece component with a first subregion made of a base material, and a second subregion made of the base material as binder, together with intercalated hard material particles, utilizing MIM technology. In the process, the second subregion is injected onto the first subregion in order to produce an integral connection between the two subregions. As a result, the first and second subregions are able to be produced by injection molding in an injection molding die.

The base material preferably is an austenitic or ferritic steel, especially steel including Fe and Cr. The hard material particles preferably are oxides, especially $Al_2O_3$, $ZrO_2$ and/or $Y_2O_3$. As an alternative, the hard material particles are carbides, in particular titanium carbide, wolfram carbide, niobium carbide or tantalum carbide. As a further alternative, the hard material particles are nitrides, especially titanium nitride. With regard to the mentioned hard material particles, it should be noted that they are able to be mixed exclusively with the base material so as to form the material for the second subregion, or they may be mixed in any desired combinations so as to form an injectable metal powder.

Preferably, a volumetric component of the hard material particles in the material for the second subregion lies in a range of 5 vol. % to 20 vol. %, and especially preferably, amounts to 10 vol. %.

Preferably, the one-piece component is a component of a motor vehicle, in particular, an internal combustion engine. Especially preferably, the one-piece component is a piston, a cylinder or a valve member, especially a valve seat, a valve stop or a needle stop. Preferably, the one-piece component is a part of gasoline injectors or fuel pumps.

In addition, the present invention relates to a method for producing a one-piece component by means of 2-component MIM technology. The method according to the present invention includes the steps of injection-molding a first subregion of the one-piece component using a base material, and injection-molding a second subregion onto the first subregion, the base material being used as binder and including intercalated hard material particles as material for the second subregion. This makes it possible for the MIM injection-molding technology to produce a one-piece component featuring an integral connection between the first and second subregions of the component.

The one-piece component according to the present invention preferably is used in applications in which the one-piece component is moving or used as a stop. For example, the use in piston pumps, splitter valves, injectors, and other mechanical valves may be possible. Another preferred possibility is the use in fuel-carrying components, especially fuels having poor lubrication properties, e.g., components for gasoline engines. In this case the use as injection valve, metering valve, quantity-control valve or fuel pumps, in particular, is conceivable.

Exemplary embodiments of the present invention are described in detail below, with reference to the accompanying drawings.

DETAILED DESCRIPTION

In the following text, a one-piece component 1 according to a first exemplary embodiment of the present invention is described in detail with reference to FIG. 1.

One-piece component 1 encompasses a first subregion 2 made of a base material, and a second subregion 3 made of a material that includes the base material as binder as well as intercalated hard material particles. An integral connection between first subregion 2 and second subregion 3 is formed in the process. One-piece component 1 is produced by means of 2-component MIM injection-molding, in which first subregion 2 is produced first, in a first step, and second subregion 3 is injection-molded onto first subregion 2 in a second step.

The use of MIM technology allows metal powders to be injection-molded, for which purpose an austenitic or ferritic steel is preferably used as base material, and for which the relatively cost-effective base material may be used as binder with additional intercalated hard material particles for the material of second subregion 3. This makes it possible to use a cost-effective binder for the hard material particles, which, for instance, are suitable oxides, carbides or nitrides.

Figure 1:
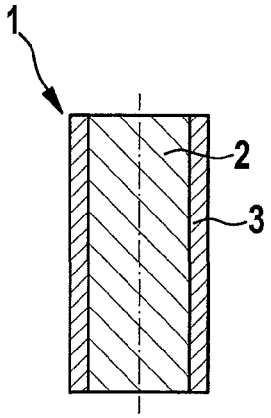
FIG. 1 a schematic sectional view of a one-piece component according to a first exemplary embodiment of the present invention.

The one-piece component shown in FIG. 1 is a piston for a piston machine and includes the wear-resistant layer on an outer surface of the piston. Since second subregion 3 forms the outer layer, high robustness with regard to frictional wear is obtained, and thus a long service life. In addition, reduced friction also leads to lower heat generation with its attendant advantages.

Figure 2:
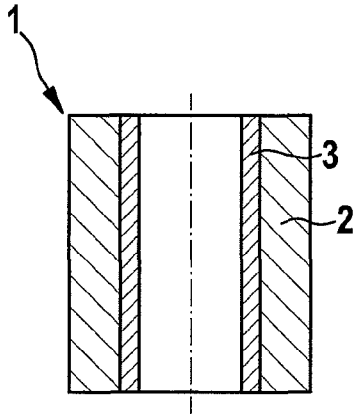
FIG. 2 a schematic sectional view of a one-piece component according to a second exemplary embodiment of the present invention.

As an alternative, exemplary one-piece component of the present invention, FIG. 2 shows a cylinder where second subregion 3 forms the bearing surface of the cylinder.

Figure 3:
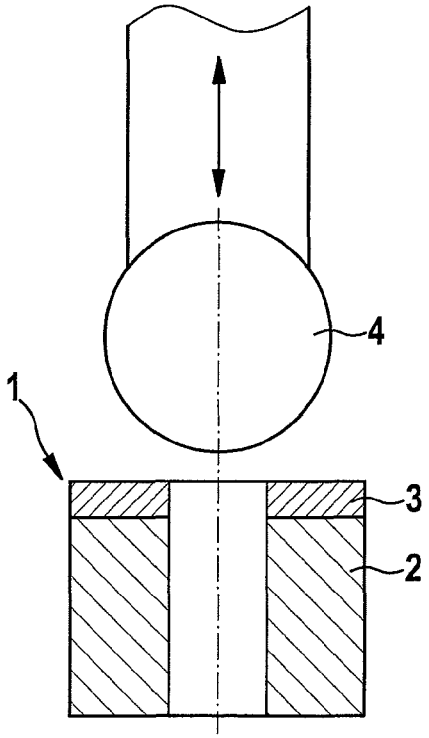
FIG. 3 a schematic sectional view of a one-piece component according to a third exemplary embodiment of the present invention.
Figure 4:
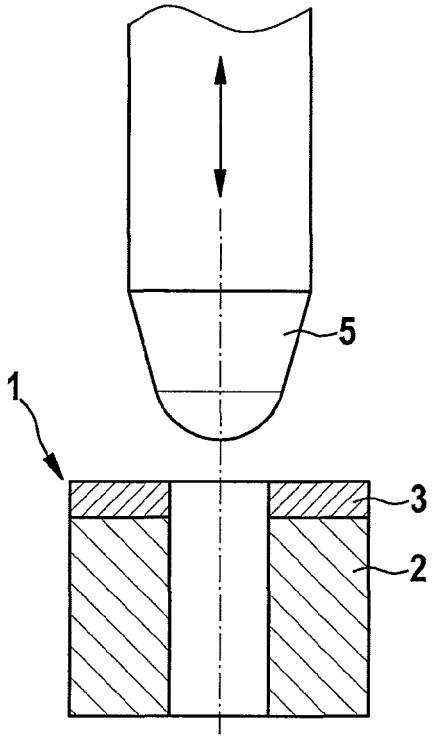
FIG. 4 a schematic sectional view of a one-piece component according to a fourth exemplary embodiment of the present invention.
Figure 5:
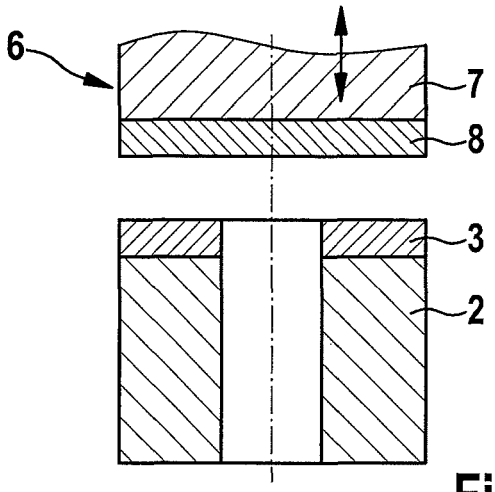
FIG. 5 a schematic sectional view of a one-piece component according to a fifth exemplary embodiment of the present invention.

FIGS. 3 through 5 show alternative exemplary embodiments of the present invention, which may be used as injectors or switching valves. Second subregion 3 forms a valve seat in each case: for a ball valve in FIG. 3, for a cone valve in FIG. 4, and for a flat-seat valve in FIG. 5. In the exemplary embodiment shown in FIG. 5, not only is the valve seat implemented as one-piece component having first and second subregions 2, 3, but valve-closure member 6 as well, which has a first subregion 7 and a second subregion 8 as valve-closure surface. The double arrows in FIGS. 3 through 5 indicate the movement direction of the valve members. However, it would also be conceivable, for example, to implement flat-seat valve as slide valve.

Figure 6:
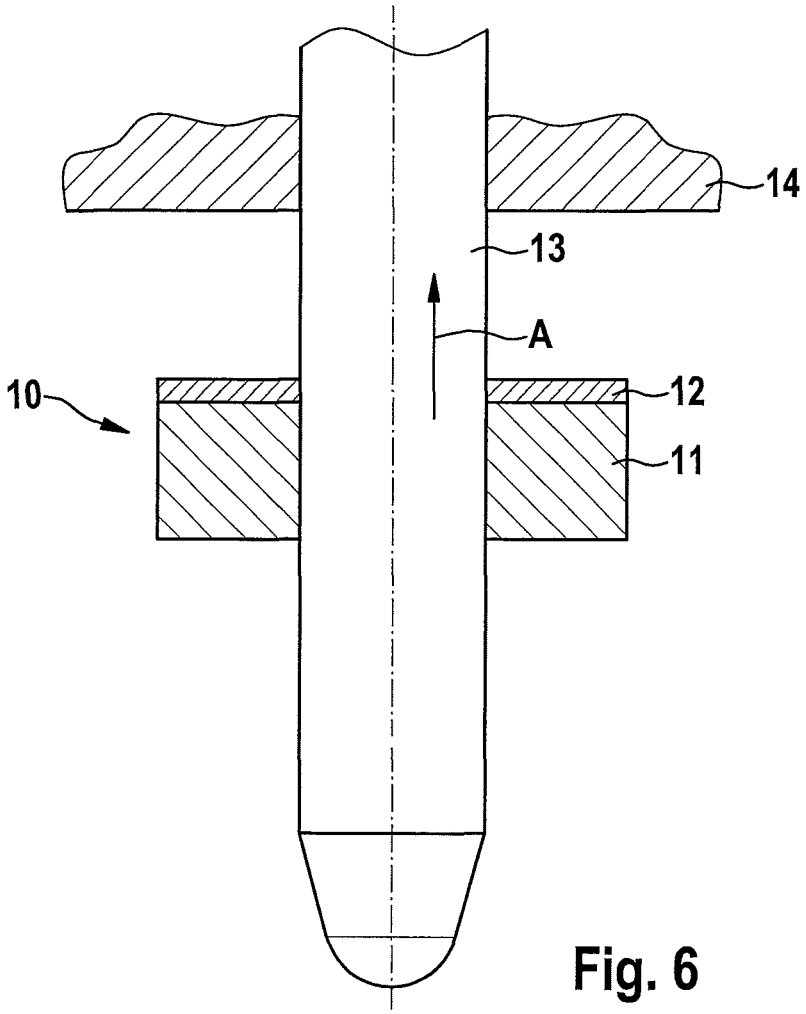
FIG. 6 a schematic sectional view of a one-piece component according to a sixth exemplary embodiment of the present invention.

FIG. 6 shows a further exemplary embodiment of the present invention in a one-piece stop 10, which features a first subregion 11 and a second, harder subregion 12. Stop 10 delimits a movement of valve member 13 in the direction of arrow A. Via second subregion 12, stop 10 strikes a counter stop 14, which likewise may possibly be made up of a first and second subregion according to the present invention.

As a result, the present invention makes it possible to provide a one-piece component, which is able to be produced in cost-effective manner using a 2-component MIM injection-molding method. For gasoline applications, austenitic or ferritic steel based on iron and chromium with a weight proportion of 13% chromium is preferably used as base material for all exemplary embodiments described.

What is claimed is:

1. A one-piece component forming a cylinder without a hole, comprising:

a first subregion made of a base material, the first subregion being a cylindrical core portion of the cylinder, the cylindrical core portion being without a hole, the cylindrical core portion having an outer radius, and a second subregion made of the base material as binder with intercalated hard material particles, the second subregion being an outer ring portion of the cylinder, the outer ring portion having an inner radius and an outer radius, the inner radius of the outer ring portion being equal to the outer radius of the cylindrical core portion, the outer radius of the outer ring portion being greater than the outer radius of the cylindrical core portion, wherein the cylindrical core portion and the outer ring portion are concentric, the second subregion being injection-molded onto the first subregion by means of MIM injection molding, so that an integral connection is formed between the first subregion and the second subregion.

2. The component according to claim 1, wherein the base material is an austenitic or ferritic steel, which includes iron and chromium.

3. The component according to claim 1, wherein the hard material particles are oxides, including $Al_2O_3$, $ZrO_2$ or $Y_2O_3$.

4. The component according to claim 1, wherein the hard material particles are one of a) carbides, including titanium carbide, wolfram carbide, niobium carbide or tantalum carbide, or b) nitrides, including titanium nitride.

* * * * *